US006688516B1

(12) United States Patent
Ussen

(10) Patent No.: US 6,688,516 B1
(45) Date of Patent: Feb. 10, 2004

(54) UNIVERSAL SEMI-AUTOMATIC FOLDABLE BOX

(76) Inventor: Bakhytbek Z. Ussen, 97327 Emigrant Springs La., #36, PMB 47 P.O. Box 387, Wasco, OR (US) 97065-0387

( * ) Notice: Subject to any disclaimer, the term of this patent is extended or adjusted under 35 U.S.C. 154(b) by 0 days.

(21) Appl. No.: 10/365,521

(22) Filed: Feb. 13, 2003

(51) Int. Cl.[7] ..... B65D 5/20

(52) U.S. Cl. ..... 229/198.2; 119/474; 229/117.03; 229/186

(58) Field of Search ..... 229/117.03, 186, 229/198.1, 198.2; 119/473, 474

(56) References Cited

U.S. PATENT DOCUMENTS

| | | | | | |
|---|---|---|---|---|---|
| 2,791,367 | A | * | 5/1957 | Mefford | 229/117.03 |
| 2,845,976 | A | | 8/1958 | Miller | |
| 3,310,219 | A | | 3/1967 | Dlugopolski | |
| 3,627,541 | A | * | 12/1971 | Farquhar | 229/186 |
| 3,708,103 | A | | 1/1973 | Evans | |
| 3,940,009 | A | | 2/1976 | Szeles | 220/564 |
| 3,945,561 | A | | 3/1976 | Strebelle | |
| 3,949,933 | A | * | 4/1976 | Giambrone et al. | 229/117.03 |
| 3,991,932 | A | | 11/1976 | Curren | 229/195 |
| 4,083,454 | A | | 4/1978 | O'Neil | 229/240 |
| 4,099,648 | A | | 7/1978 | Kirkton | 220/841 |
| 4,463,997 | A | | 8/1984 | Densen | 312/259 |
| 4,509,645 | A | | 4/1985 | Hotta | 206/545 |
| 4,606,461 | A | | 8/1986 | Bolton | 206/600 |
| 5,183,177 | A | | 2/1993 | Yu | 220/523 |
| 5,193,701 | A | | 3/1993 | Bush | 220/4.33 |
| 5,197,659 | A | | 3/1993 | Vassiliou | 229/117.01 |
| 5,273,206 | A | | 12/1993 | Vassiliou | 229/117.01 |
| 5,429,261 | A | | 7/1995 | Machino | 220/7 |
| 5,544,619 | A | * | 8/1996 | Braun | 119/474 |
| 5,778,594 | A | * | 7/1998 | Askins et al. | 119/474 |
| 5,868,306 | A | | 2/1999 | Wen-Tsan | 229/120.07 |
| 5,913,474 | A | | 6/1999 | Chu | 229/167 |
| 5,996,885 | A | | 12/1999 | Chu | 229/179 |
| 6,003,708 | A | | 12/1999 | Meyering | 220/6 |
| 6,041,998 | A | | 3/2000 | Goldberg | 229/193 |
| 6,149,025 | A | | 11/2000 | Wang | 220/6 |
| 6,332,554 | B1 | | 12/2001 | McCarthy | 220/554 |
| 6,474,541 | B1 | | 11/2002 | Chu | 229/196 |

* cited by examiner

*Primary Examiner*—Gary E. Elkins

(57) ABSTRACT

An universal semi-automatic foldable box is generally disclosed comprising a box body (1) having a bottom panel (2), and two or more side walls (5), and the corresponding number of soft sheets (9) and spring strips (11). Each spring strip is connected to the bottom panel and at least one side wall. The side walls are connected to the bottom panel such that they can unfold and rise and the sheets form foldable connecting portions for connecting the side walls, and the spring strips serve to unfold the box flat. The spring strip has the property of remaining straight when unfolded but self-folding when it is slightly bent from its straight condition. The spring strips may be provided as an integral part of the box, or alternatively, may be a separate piece, which then can be attached by the user to the side walls of the box. The box body can be of different size and shape, such as for example square, sphere, rectangular, hexagonal, octagonal, and the like, and can be made of any material. A box of this invention can be utilized for a variety of different storage applications and can be used in any kinds of environment in which a box would be used.

14 Claims, 18 Drawing Sheets

UNIVERSAL SEMI-AUTOMATIC FOLDABLE BOX

CROSS-REFERENCE TO RELATED APPLICATIONS

Not applicable.

BACKGROUND—STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISK APPENDIX

Not applicable.

BACKGROUND—FIELD OF INVENTION

This invention relates to a semi-automatic box, tote box, or storage box, particularly to a box for holding a variety of content, including without limitation, general merchandise, fresh produce and toys, and which can be unfolded flat.

BACKGROUND—DESCRIPTION OF PRIOR ART

There are many kinds of boxes or containers known in the art that are used for holding goods for storage and transportation. However, all of the known boxes have, respectively, various disadvantages. Specifically, some boxes are not re-usable. Examples of such prior boxes are U.S. Pat. No. 3,708,103 (Evans); U.S. Pat. No. 4,083,454 (O'Neil); and U.S. Pat. No. 5,197,659 (Vassiliou).

Some boxes do not unfold flat as sheet-like. Examples of such prior boxes are U.S. Pat. No. 4,606,461 (Bolton); U.S. Pat. No. 5,429,261 (Machino); U.S. Pat. No. 5,868,306 (Wen-Tsan); and U.S. Pat. No. 6,149,025 (Wang).

Foldable boxes are mostly monolithic (one piece) containing primary folding lines provided to users, who fold them on demand to enclose an item to be stored. Process of assembly and unfolding of such box is relatively slow and complicated. Examples of such prior boxes are U.S. Pat. No. 3,310,219 (Dlugopolski); U.S. Pat. No. 3,708,103 (Evans); U.S. Pat. No. 3,991,932 (Curren); U.S. Pat. No. 4,083,454 (O'Neil); U.S. Pat. No. 4,463,997 (Densen); U.S. Pat. No. 4,509,645 (Hotta); U.S. Pat. No. 5,868,306 (Wen-Tsan); U.S. Pat. No. 5,913,474 (Chu); U.S. Pat. No. 5,996,885 (Chu); U.S. Pat. No. 6,041,998 (Goldberg); and U.S. Pat. No. 6,474,541 (Chu).

Such boxes cannot fold or unfold with contents being inside the box, and require emptying of the box prior to folding or unfolding. Examples of such prior boxes are U.S. Pat. No. 3,310,219 (Dlugopolski); U.S. Pat. No. 3,708,103 (Evans); U.S. Pat. No. 3,991,932 (Curren); U.S. Pat. No. 4,083,454 (O'Neil); U.S. Pat. No. 4,463,997 (Densen); U.S. Pat. No. 5,868,306 (Wen-Tsan); U.S. Pat. No. 5,913,474 (Chu); U.S. Pat. No. 5,996,885 (Chu); U.S. Pat. No. 6,041, 998 (Goldberg); and U.S. Pat. No. 6,474,541 (Chu).

Also, such monolithic boxes or containers, even in their collapsed state, may occupy considerable area. Examples of such boxes are U.S. Pat. No. 3,310,219 (Dlugopolski); U.S. Pat. No. 3,991,932 (Curren); U.S. Pat. No. 4,463,997 (Densen); U.S. Pat. No. 4,509,645 (Hotta); U.S. Pat. No. 5,868,306 (Wen-Tsan); U.S. Pat. No. 5,913,474 (Chu); U.S. Pat. No. 5,996,885 (Chu); U.S. Pat. No. 6,041,998 (Goldberg); and U.S. Pat. No. 6,474,541 (Chu).

Other problem of a monolithic box is that if any part of the box is broken or otherwise damaged, then the box itself is no longer suitable for the use.

Foldable to flat box, such as disclosed in U.S. Pat. No. 3,708,103 (Evans); U.S. Pat. No. 3,991,932 (Curren); U.S. Pat. No. 4,509,645 (Hotta); U.S. Pat. No. 5,868,306 (Wen-Tsan); U.S. Pat. No. 6,041,998 (Goldberg) is portable and is not capable of being stacking up with heavy load.

Furthermore, prior art boxes, as disclosed in U.S. Pat. No. 3,310,219 (Dlugopolski); U.S. Pat. No. 3,708,103 (Evans); U.S. Pat. No. 3,991,932 (Curren); U.S. Pat. No. 4,509,645 (Hotta); U.S. Pat. No. 5,868,306 (Wen-Tsan); U.S. Pat. No. 5,996,885 (Chu); U.S. Pat. No. 6,041,998 (Goldberg); and U.S. Pat. No. 6,474,541 (Chu), present substantial limitation on material of which the box can be made.

Some boxes require excessive use of materials. Examples of such prior boxes are U.S. Pat. No. 3,310,219 (Dlugopolski); U.S. Pat. No. 3,991,932 (Curren); U.S. Pat. No. 4,083,454 (O'Neil); U.S. Pat. No. 5,868,306 (Wen-Tsan); U.S. Pat. No. 5,913,474 (Chu); U.S. Pat. No. 5,996, 885 (Chu); U.S. Pat. No. 6,041,998 (Goldberg); and U.S. Pat. No. 6,474,541 (Chu).

U.S. Pat. No. 2,845,976 (Miller); U.S. Pat. No. 3,940,009 (Szeles); U.S. Pat. No. 3,945,561 (Strebelle); U.S. Pat. No. 4,099,648 (Kirkton); U.S. Pat. No. 5,183,177 (Yu); U.S. Pat. No. 5,193,701 (Bush); U.S. Pat. No. 5,273,206 (Vassiliou); U.S. Pat. No. 6,003,708 (Meyering); and U.S. Pat. No. 6,332,554 (McCarthy) show various boxes and containers.

None of the above references or any other reference known to Applicant discloses, mentions or suggests a semi-automatic foldable box as described and claimed hereinbelow.

SUMMARY OF INVENTION

The present invention has been designed to overcome the foregoing problems with known tote or storage boxes and containers.

In accordance with the present invention, a semi-automatic box is formed of a bottom panel, and two or more side walls and the corresponding number of soft cloth sheets. The side walls are connected to the bottom panel such that they can unfold and rise and the sheets form foldable connecting portions for connecting the side walls.

The principle feature of the invention is to provide a self-folding box structure which includes a self-folding spring strip connected to the bottom panel and at least one side wall. The spring strip has a biasing such that when unfolded and straightened, the spring strip maintains its straightened shape, but when the strip is bent, initiation of self-folding occurs and side walls are self-raised to form the box. The box can be unfolded flat, and then easily returned to its normal shape by merely bending the spring strips attached to the side walls to self-fold and thereby lift-up the side walls, and such folding and unfolding can be done repeatedly.

The spring strips may be provided as an integral part of a box, or alternatively, may be a separate piece, which then can be attached by the user to the side walls of the box.

The box of this invention can be of different shapes, such as for example square, sphere, rectangular, hexagonal, octagonal, and the like.

Objects and Advantages

Accordingly, several objects and advantages of the present invention are:

(a) to provide a semi-automatic foldable box, which in erected position can be utilized for a variety of different storage applications, from personal small items to toys and laundry, and to various home appliances and tools. Being suitable for manufacturing at different sizes, shapes and material, it can be used as a container for food stuffs, or a container for transporting and storing fresh fruits and vegetables, or as a cage for convenient transportation of pets, etc.;

(b) to provide a semi-automatic foldable box, which can be easily and quickly unfolded flat, and available as a sheet or carpet when unfolded;

(c) to provide a semi-automatic foldable box, which can be instantly unfolded flat or folded back to its erected position for storing of the contents, allowing easy access to the contents of the box and without the need to remove the contents from the box prior to its folding or unfolding;

(d) to provide a semi-automatic foldable box, which can be easily and quickly assembled and set up when in use, and conveniently collapsed and disassembled when not in use;

(e) to provide a semi-automatic foldable box, which, when each side wall rises, is box-like-shaped to form the box, and is sheet-like shaped when each side wall is unfolded to be available as a sheet or carpet, thereby enabling effective utilization of space when unfolded, stored or transported;

(f) to provide a semi-automatic foldable box, which in its collapsed (disassembled) state will occupy relatively small space;

(g) to provide a semi-automatic foldable box, which is reusable;

(h) to provide a semi-automatic foldable box, which is durable and can be used in any kinds of environment in which a box would be used;

(i) to provide a semi-automatic foldable box, which is very economical and efficient it terms of material requirement;

(j) to provide a semi-automatic foldable box, which is easily constructed from readily available materials and manufacturing process and which is therefore both inexpensive and readily adapted for different purposes and uses;

(k) to provide a semi-automatic foldable box, any part of which can be easily replaced with the new one, thereby ensuring longevity of the box's life;

(l) to provide a semi-automatic foldable box, which can be effectively used for storage of children's toys and will allow the children to instantly turn the toy box into a playing field where all toys stored in the box are available immediately after an easy and quick unfolding of the box; and (m) to provide a semi-automatic foldable box, which, if necessary, is capable of stacking-up to bear heavy load for a relatively long period of time.

Further objects and advantages of my invention will become apparent from a consideration of the drawings and ensuing description.

DRAWING FIGURES

The accompanying drawings further describe the invention.

Figure 1:
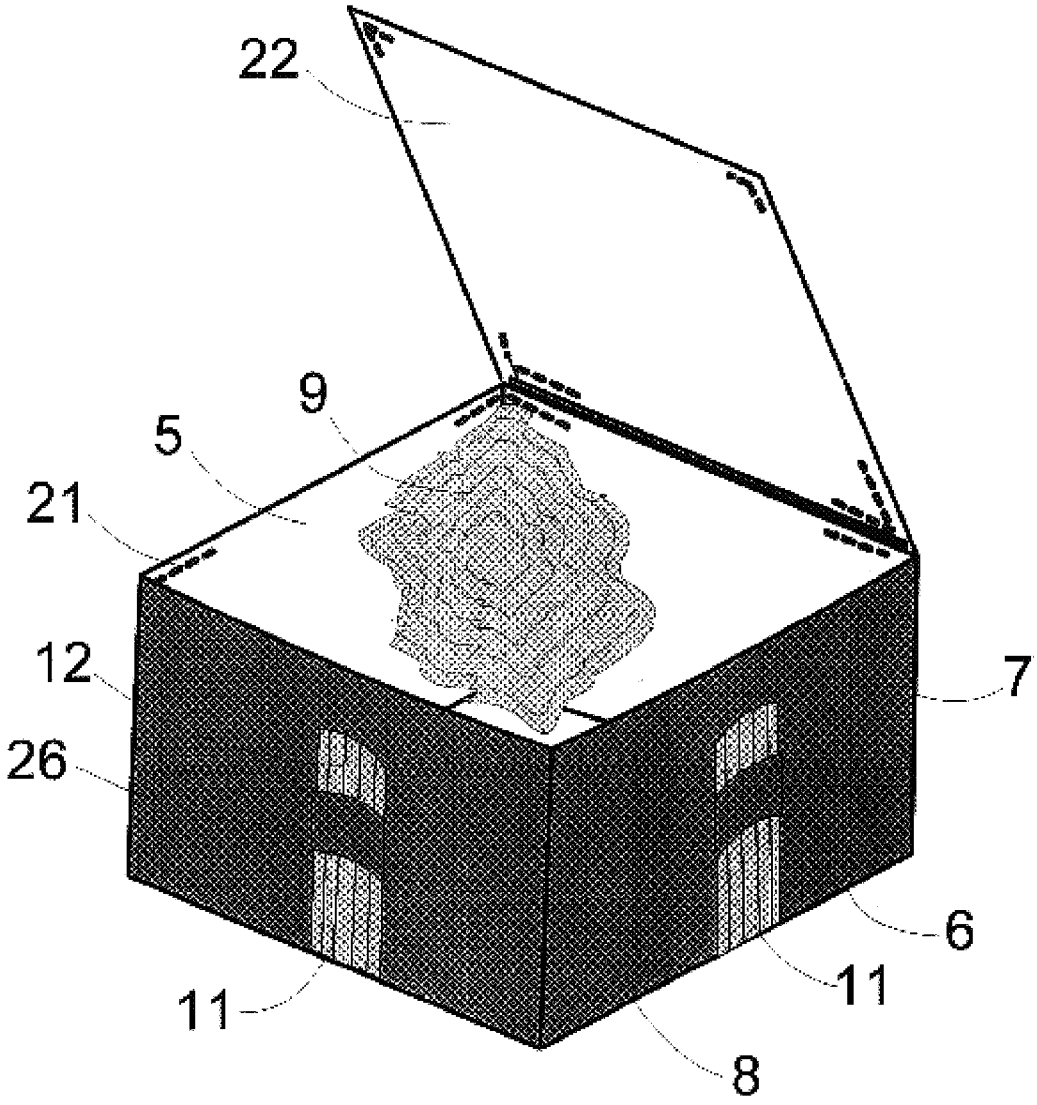
FIG. 1 is a perspective view of the box shown in assembled (erected) condition.

FIGS. 14, 15, 16, 17*a* and 17*b* show various aspects of the device constructed in accordance with the invention.

REFERENCE NUMERALS IN DRAWINGS

| | | | |
|---|---|---|---|
| 1 | box body | 2 | bottom panel |
| 3 | side edge of bottom panel | 4 | outer side of bottom panel |
| 5 | side wall | 6 | bottom edge of side wall |
| 7 | side edge of side wall | 8 | outer side of side wall |
| 9 | connecting portion | 10 | side edge of connecting portion |
| 11 | spring strip | | |
| 13 | bottom end of spring strip | 12 | top end of spring strip |
| 15 | concave surface of spring strip | 14 | middle part of spring strip |
| 17 | folded state of spring strip | 16 | convex surface of spring strip |
| 19 | intermediate state of spring strip | 18 | unfolded state of spring strip |
| 21 | magnet | 20 | highest energy state |
| 23 | wheel | 22 | lid |
| 25 | fold inhibiting device | 24 | covering sheet |
| 27 | folding line | 26 | retaining and fastening element |
| | | 28 | content |

DESCRIPTION OF INVENTION

Preferred Embodiment

A preferred embodiment of the device of the present invention is illustrated in FIGS. 1–8. The box has a body 1 having a bottom panel 2, and two or more side walls 5, and the corresponding number of connecting portions 9 and spring strips 11. In the preferred embodiment, the bottom panel 2 is rectangular, and there are, respectively, four side walls 5, four connecting portions 9, and four spring strips 1. Side walls 5 are made of any firm and durable material, for example, cardboard, plastic, wood, metal, etc. Connecting portions 9 are made of any material, which is soft, strong, and thin and is capable of folding. Side edges 3 of bottom panel 2, and bottom edges 6 and side edges 7 of side walls 5, and side edges 10 of connecting portions 9, are provided with magnet support 21 for enhancing support strength of the box. The spring strips 11 serve to unfold the box flat, and to fold the box securing it into shape.

Each spring strip 11 has a biasing such that when unfolded and straightened, the spring strip maintains its straightened shape, but when the strip is bent, initiation of self-folding occurs and side walls 5 are self-raised to form the box.

Spring strip 11 is made of material having a continuum of mechanical energy states. An unfolded state 18 of the strip 11 is a stable state of equilibrium having high energy. In the unfolded state 18 the strip 11 is extended linearly in the longitudinal direction and has a slight curvature around the longitudinal axis. A folded state 17 of the strip 11 is a stable state of equilibrium having low energy. Between these unfolded and folded states is a continuum of unstable non-equilibrium states, most of which have energies intermediate between the energies of the unfolded and folded states. In these intermediate energy states the strip is partly folded and spontaneously releases its energy and moves toward more folded states.

Figure 3:
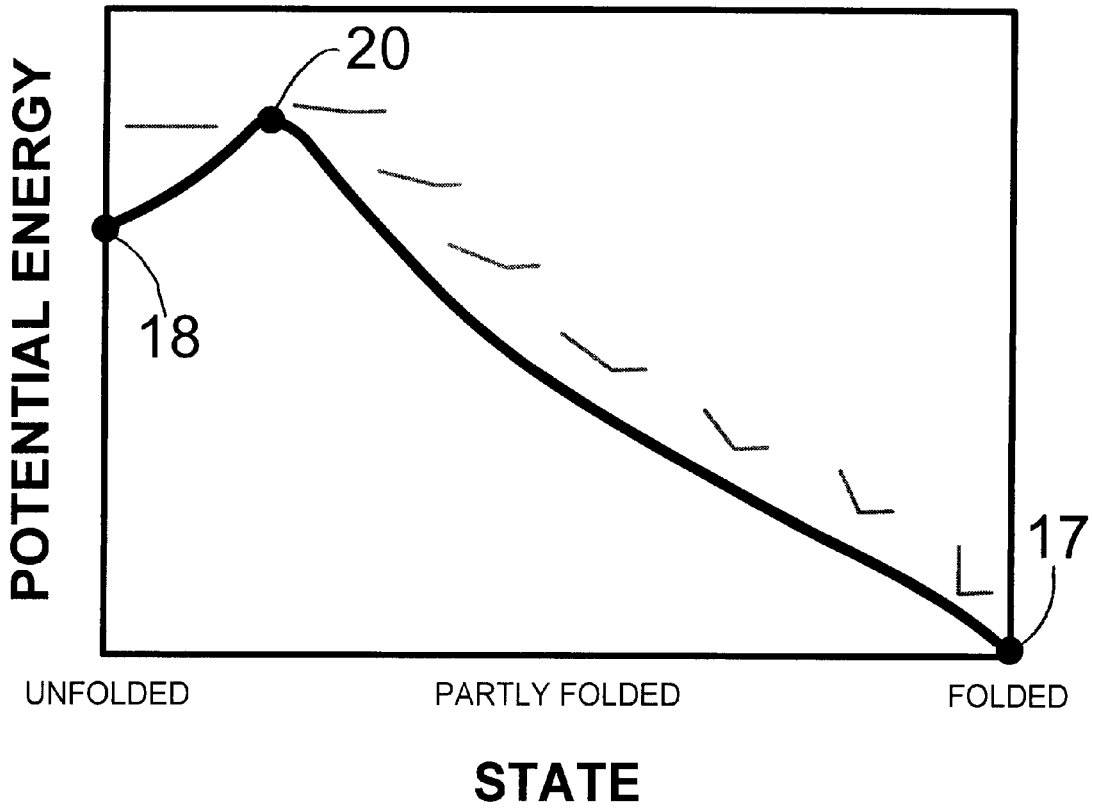
FIGS. 3 and 4 is a graph of the spring strip energy vs. spring strip state, according to the preferred embodiment of the present invention.
Figure 4:
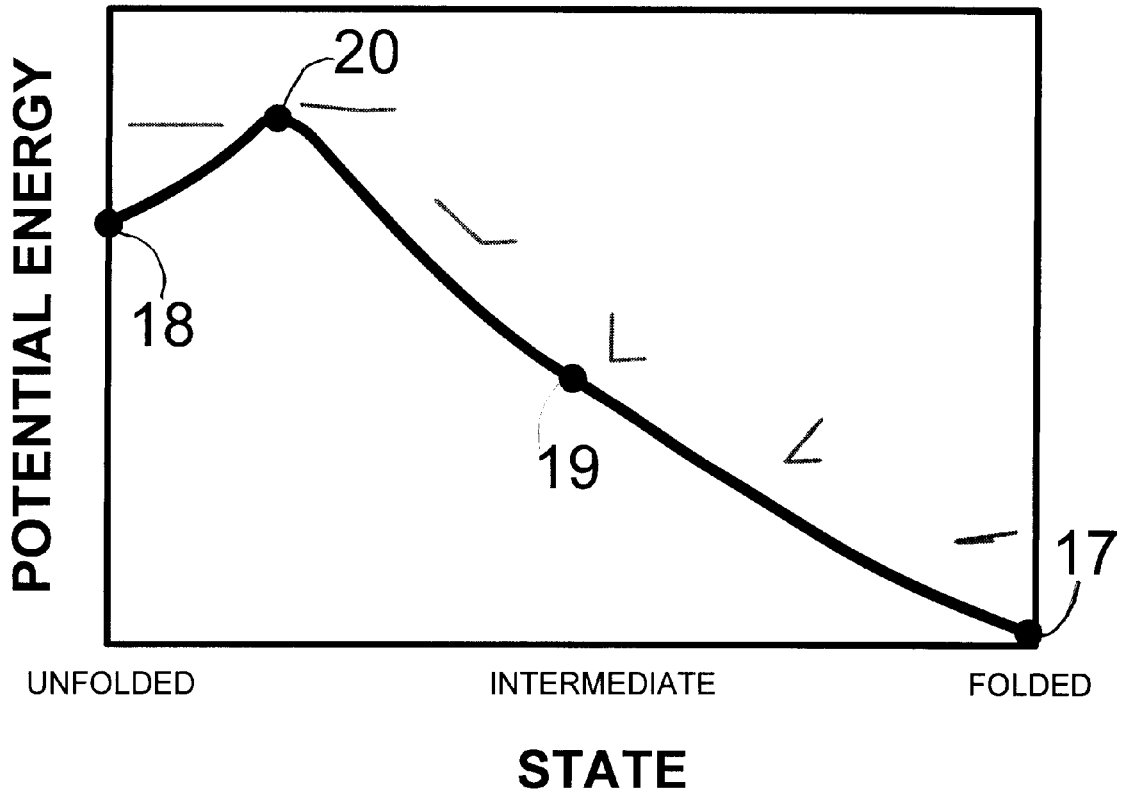

FIGS. 3 and 4 show a graph illustrating the relationship between the mechanical potential energy of the strip 11 and its state.

At the left side of the graph is the unfolded state 18 of the strip 11, which has a high energy, while at the right side of the graph is the folded state 17 of the strip 11, which has a low energy. Near the folded state is a region of unstable states of energy slightly higher than that of the folded state. Consequently, the flattened strip remains in the unfolded state until it is pushed out of this equilibrium state and past the intermediate state characterized by the maximal amount of energy 20. The strip then spontaneously folds and releases its energy until it arrives in the folded state 17 of lowest energy or is arrested in an intermediate state 19 by an external restraining force, such as, for example, magnet supports 21 of side edges 7 of side walls 5. A folded or partly folded strip may be flattened by for forcibly unfolding it. If the strip is pushed flat past the highest energy state 20, then it spontaneously snaps into the unfolded state of equilibrium. To flatten a folded strip, or fold a flat strip, the strip must be given sufficient activation energy to push the strip over the peak 20. Once pushed over the peak, the strip relaxes into the folded state 17 or unfolded state 18.

The activation force required to fold the spring strip 11 is generally proportional to the spring strength. Activation force measurements may be performed with a standard Wagner Gauge used to measure activation forces and physical properties of materials.

Strips possessing the essential defining properties described above may be composed of any of various materials such as metal, plastic, or other suitable natural or synthetic compound or ferrous or non-ferrous laminate. In the preferred embodiment of the present invention, the strip is composed of carbon spring steel—a metal alloy treated by a well-known process of coiling, winding, and forming that results in a strip of steel having a slight arc centered around its longitudinal axis, and exhibiting the energetic properties described above. The process can be adapted to strips of various sizes and thickness, and can also be adapted to create strips having various properties such as different folding radii and different folding forces.

Self-folding occurs on the convex side 16 of spring strip 11. Therefore, it is preferable to have the concave side 15 of spring strip 11 face the interior of the box so that the self-folding of the spring strip 11 more easily lifts up side walls 5.

To prevent unexpected initiation of self-folding of the spring strip 11, the spring strip may be equipped with the inhibiting device 25, which inhibits a bending and initiation of the folding of spring strip 11. The device 25 may be an inflexible tubular sleeve which press fits over the top end 12 of the strip 11, or may even be a simple winding of inextensible tape or other materials around end 12.

Figure 7:
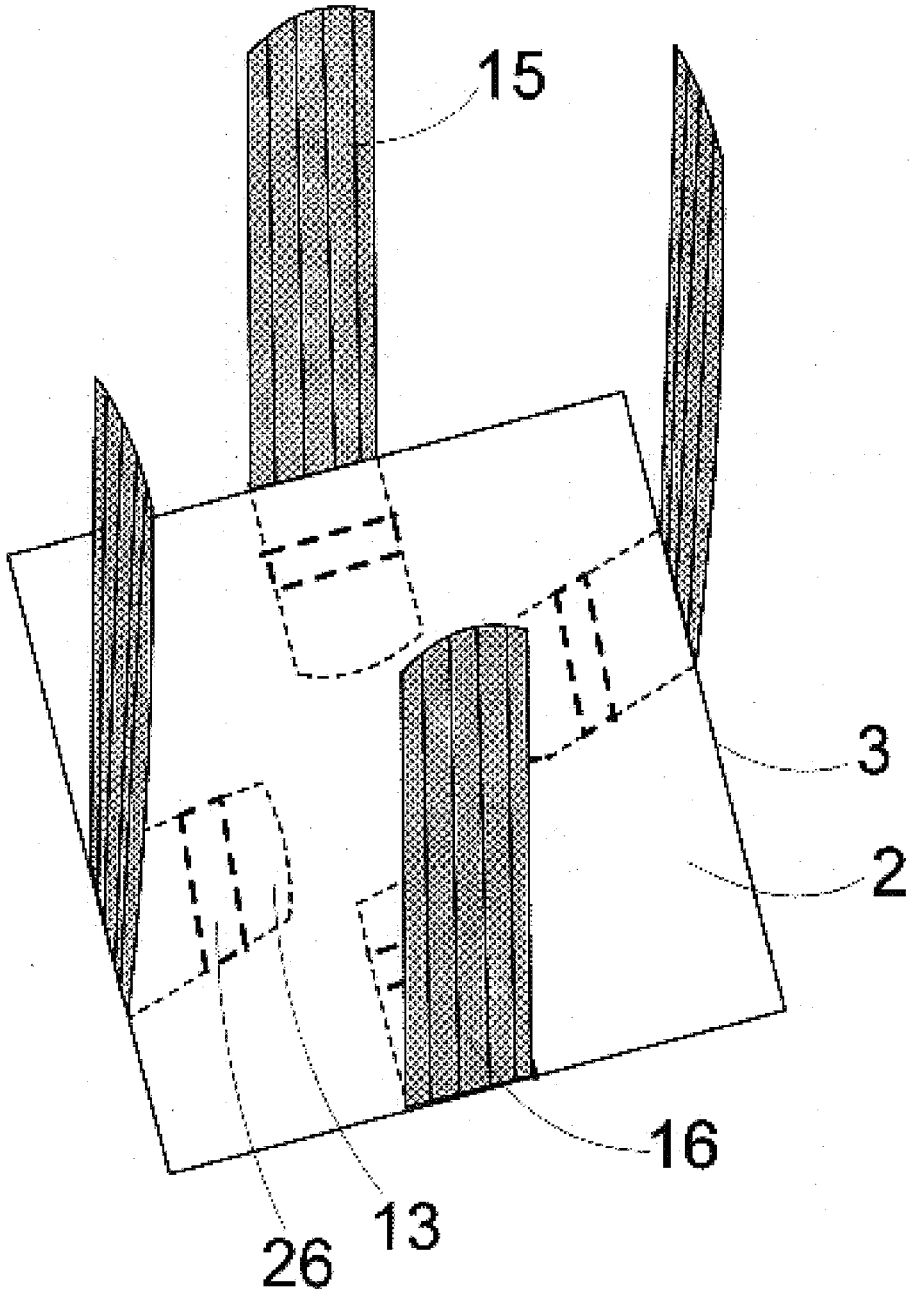
FIGS. 7 and 8 is a perspective view of the box during assembly.
Figure 8:
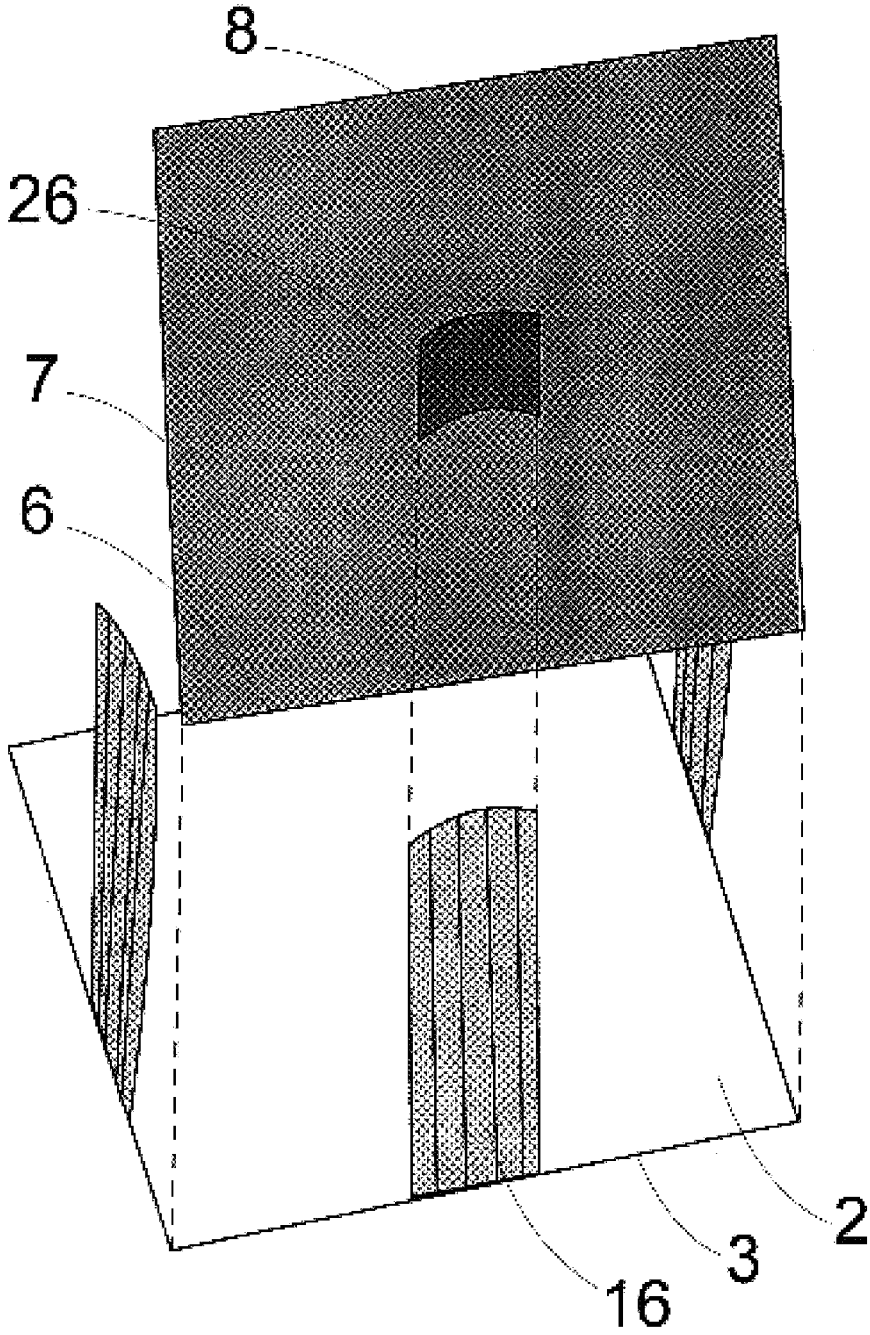

To assemble the box, (i) bottom end 13 of each spring strip 11 has to be connected to the bottom panel 2 and fixed with the retaining and fastening element 26, as shown in FIG. 7; (ii) side walls 5 have to be connected to the bottom panel 2 such that they can unfold and rise as it is shown in FIG. 8; (iii) side edges 7 of side walls 5 have to be connected to respective side edges 10 of connecting portions 9; and (iv) top end 12 of each spring strip 11 has to be connected to one side wall 5. The connection may be secured by means of retaining and fastening elements 26 located, respectively, at the outer side 4 of the bottom panel 2 and the outer side 8 of side walls 5.

A box is operating as follows: When the spring strips 11 connected to the side walls 5 are straightened, the box is unfolded, and is available as a sheet or carpet. When the spring strips 11 are slightly bent, the box is easily returned to its normal shape by self-folding and thereby lifting-up the side walls 5. Folding and unfolding can be done repeatedly without the need to emptying the box.

Figure 15:
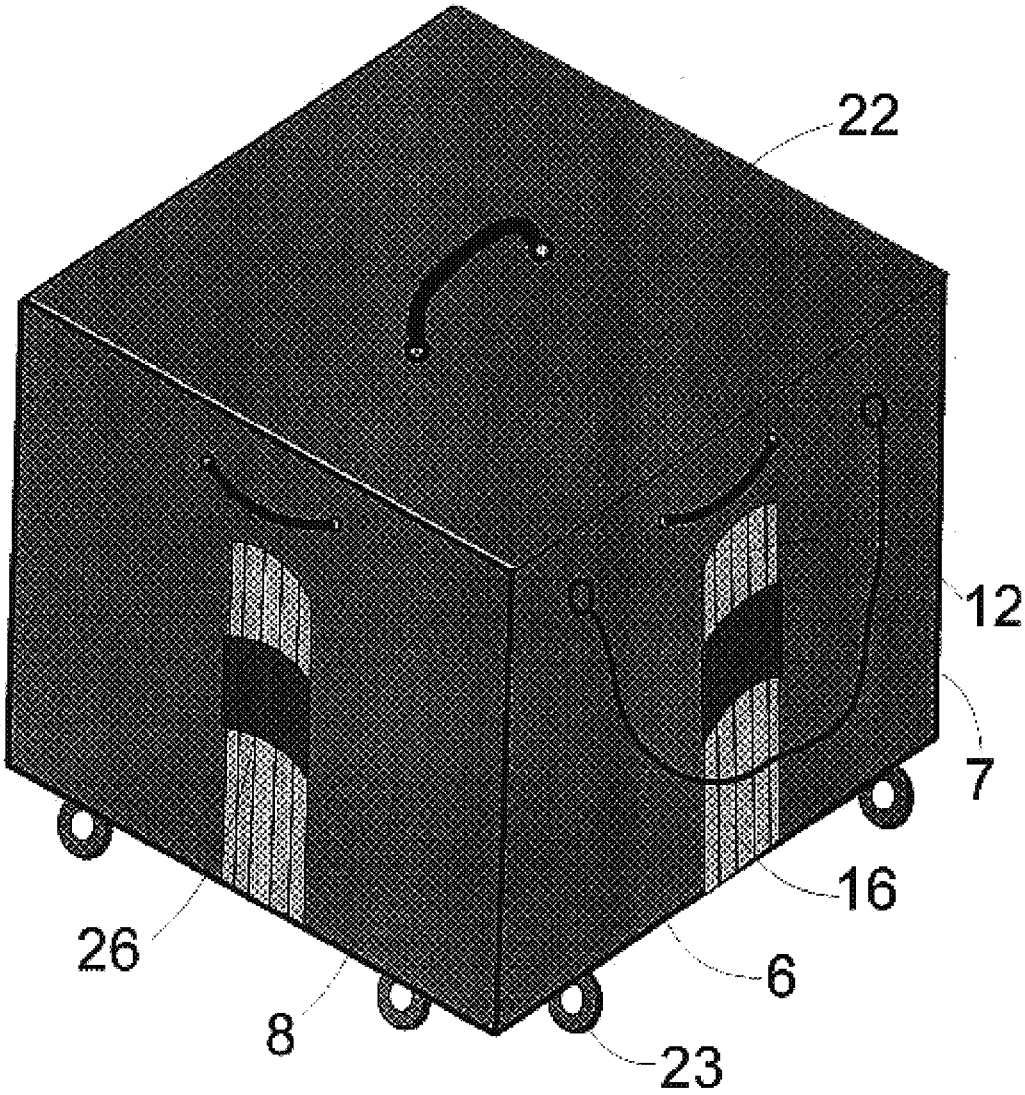

The box may have a variety of attachments, for example, a lid 22, wheels 23 and others, as shown in FIG. 15.

Figure 5:
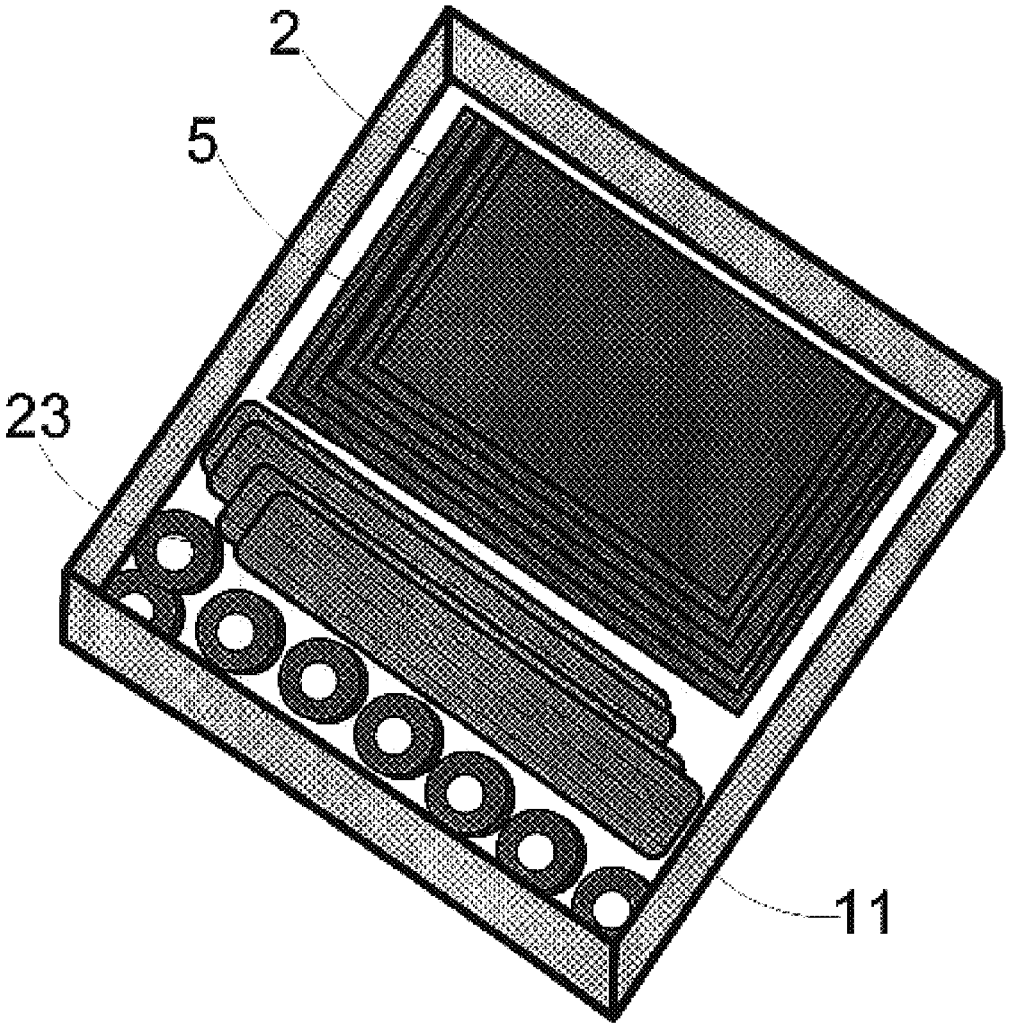
FIG. 5 is a perspective view of the preferred embodiment of the a box of the invention, shown in disassembled (collapsed) condition.
Figure 6:
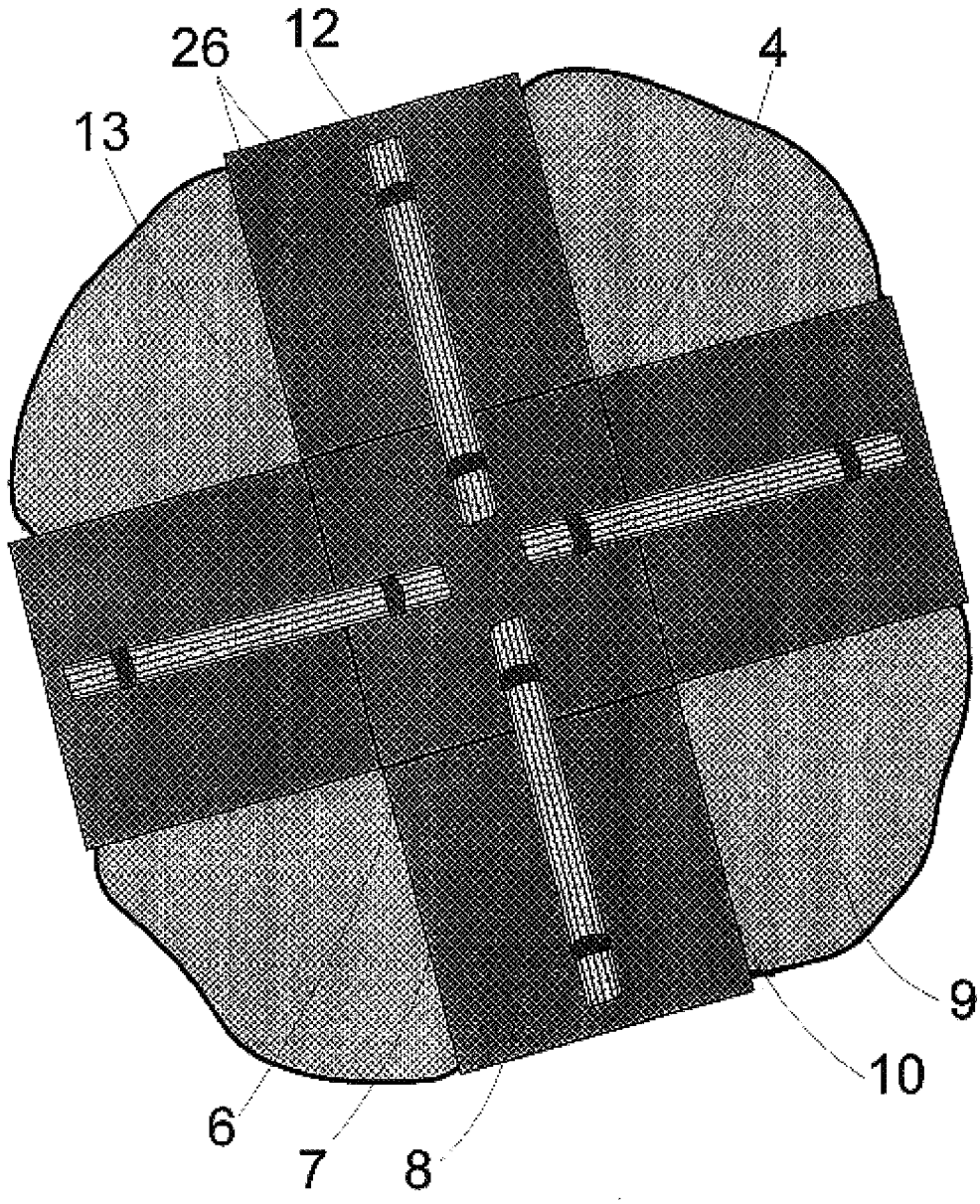
FIG. 6 is a bottom view of the preferred embodiment of a box of the invention which is unfolded.

When the box is not in use it can be conveniently disassembled and packed for storage, as shown in FIG. 5. To disassemble the box the user needs to (i) release the fastening elements 26 and disconnect and detach the spring strips 11 from the bottom panel 2 and the respective side walls 5; (ii) disconnect and detach the side edges 7 of side walls 5 from respective side edges 10 of connecting portions 9; and (iii) disconnect and detach the side walls 5 from the bottom panel 2.

A box constructed in accordance with the preferred embodiment can be effectively used to hold the children's toys or a person's laundry, or to store and transport fresh fruits and vegetables. The user can instantly turn the box into a flat sheet or carpet where all contents 28 of the box are available immediately after an easy and quick unfolding of the box, as shown, for example, in FIG. 14.

DESCRIPTION OF INVENTION

Additional Embodiment

Figure 9:
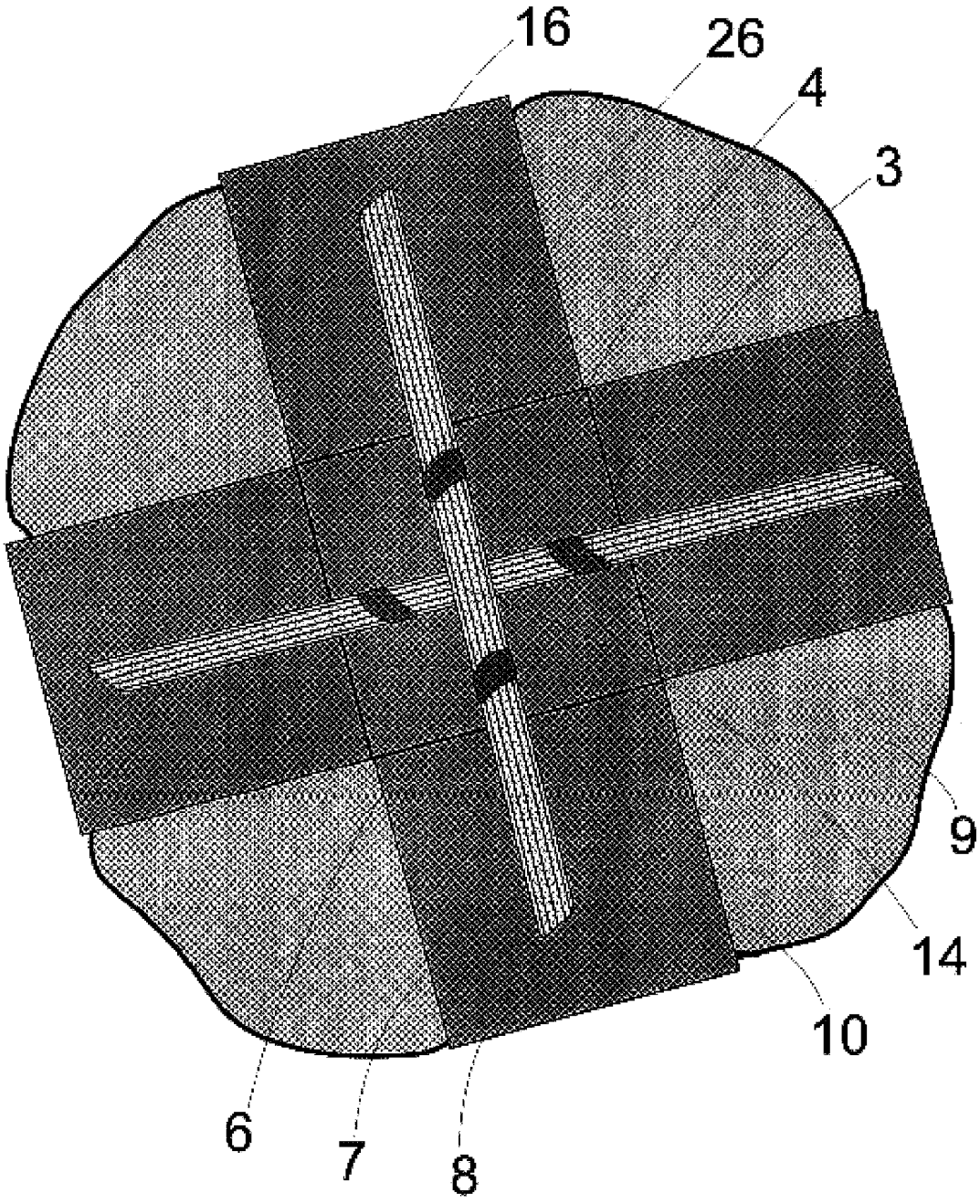
FIG. 9 is a bottom view of the additional embodiment of a box of the invention which is unfolded.
Figure 10:
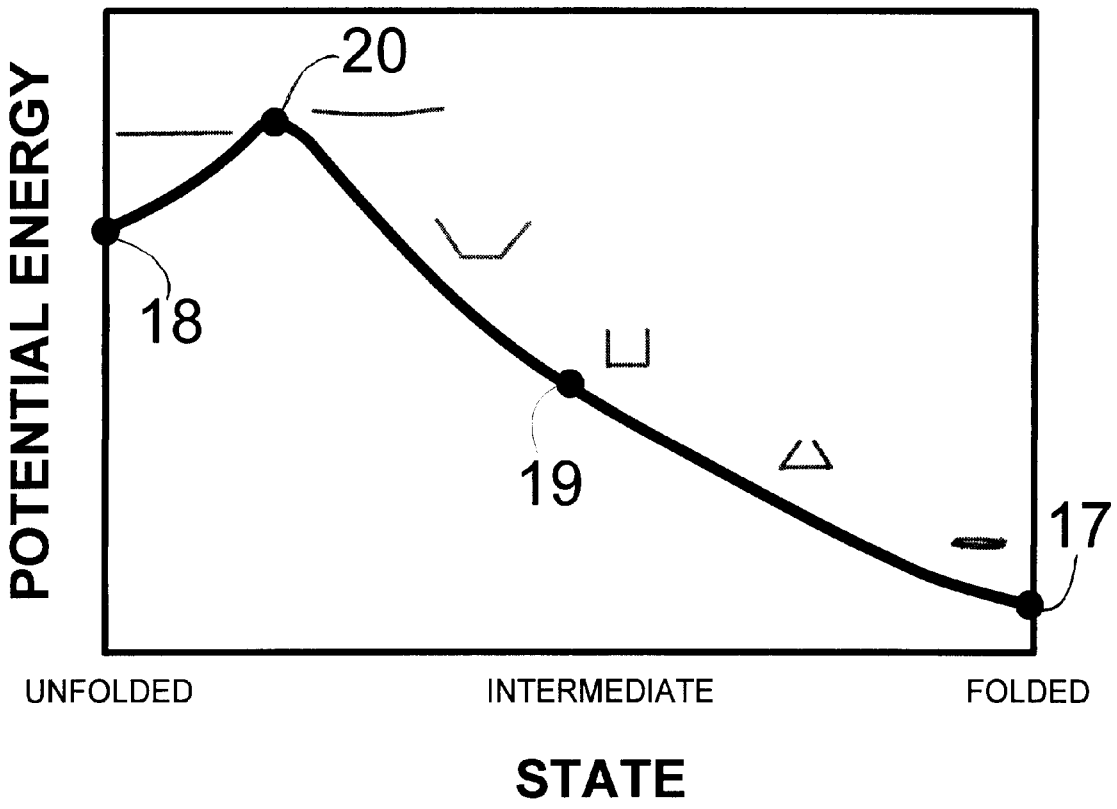
FIG. 10 is a graph of the spring strip energy vs. spring strip state, according to the additional embodiment of the present invention.
Figure 11:
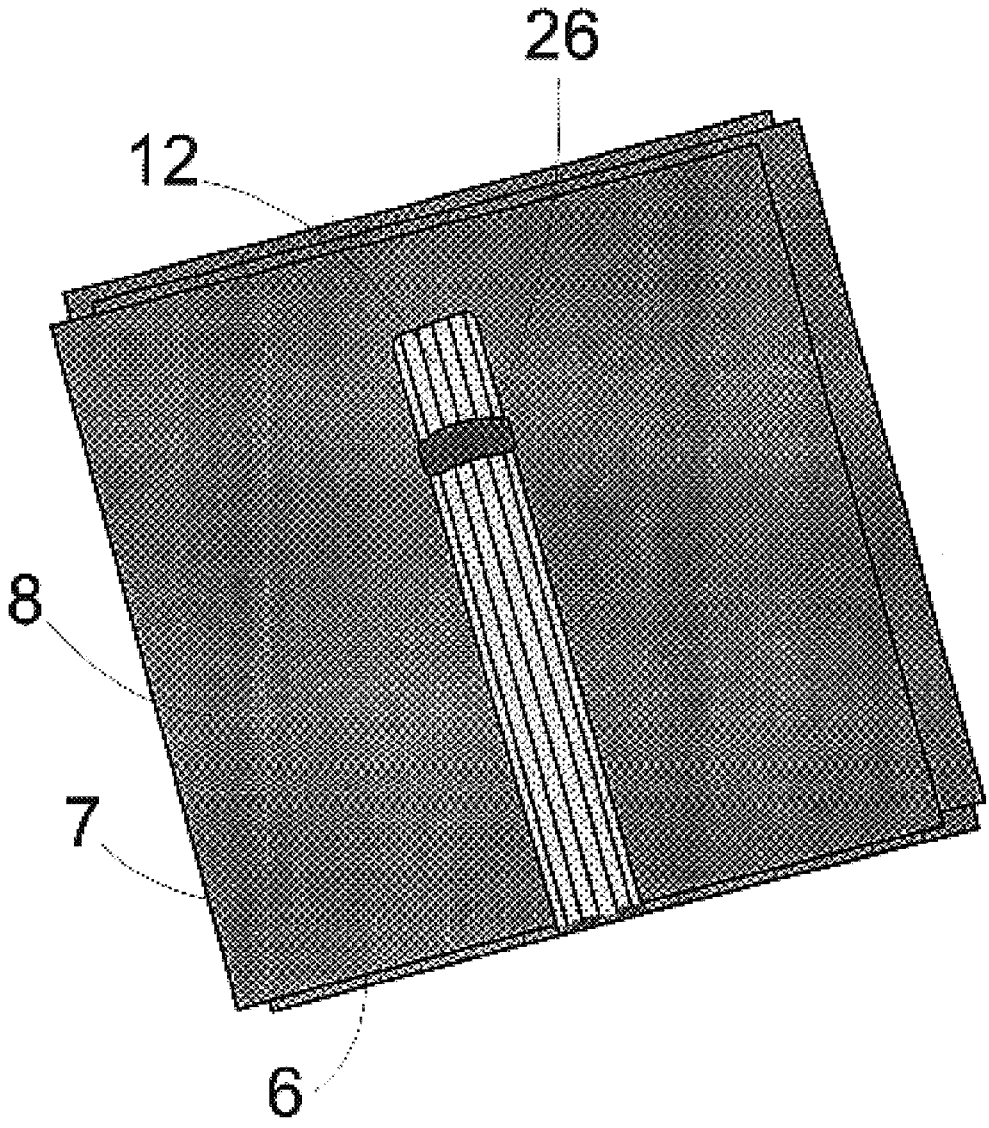
FIG. 11 is a perspective view of the additional embodiment of the a box of the invention, shown in disassembled (collapsed) condition.

An additional embodiment is shown in FIGS. 9–11. There are two spring strips 11, and middle part 14 of each spring strip 11 is connected to the bottom panel 2, and two ends 12 and 13 of each spring strip 11 are connected to two opposing side walls 5.

FIG. 10 is a graph illustrating the relationship between the mechanical potential energy of the strip 11 and its state.

Operation of the box is the same as described in the preferred embodiment above.

Because the folded state 17 of the strip 11 has the lowest energy, the strip tends to fold until it arrives in the folded state 17. Thus, the box of the additional embodiment may be disassembled (collapsed) by bringing the side walls 5 forward until they are flat. FIG. 11 illustrates the box of this embodiment in disassembled (collapsed) condition.

DESCRIPTION OF INVENTION

Alternative Embodiments

Figure 12:
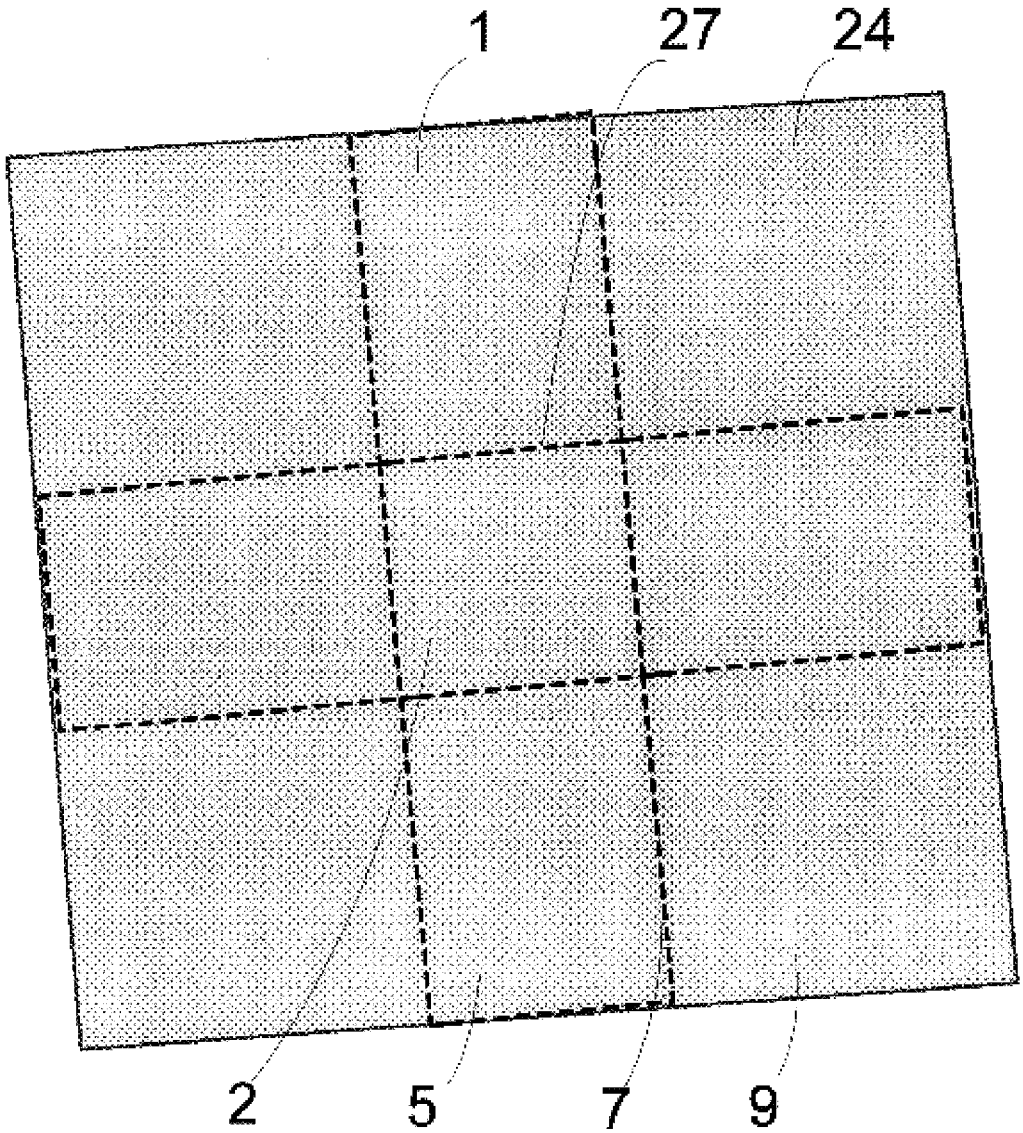
FIG. 12 is a perspective view of an alternative embodiment of a box of the invention which is unfolded, and wherein the box body is a monolithic construction.

In FIG. 12 is shown an alternative embodiment, wherein the box body 1 is a monolithic construction, wherein side walls 5 are foldable along the scored folding lines 27. A rectangular sheet 24 covers the inner surfaces of the bottom panel 2 and side walls 5 and connects the side edges 7 thereof so that four corners of the sheet 24 positioned between the side edges 7 of side walls 5 constitute connecting portions 9 for connecting each side wall.

Figure 13:
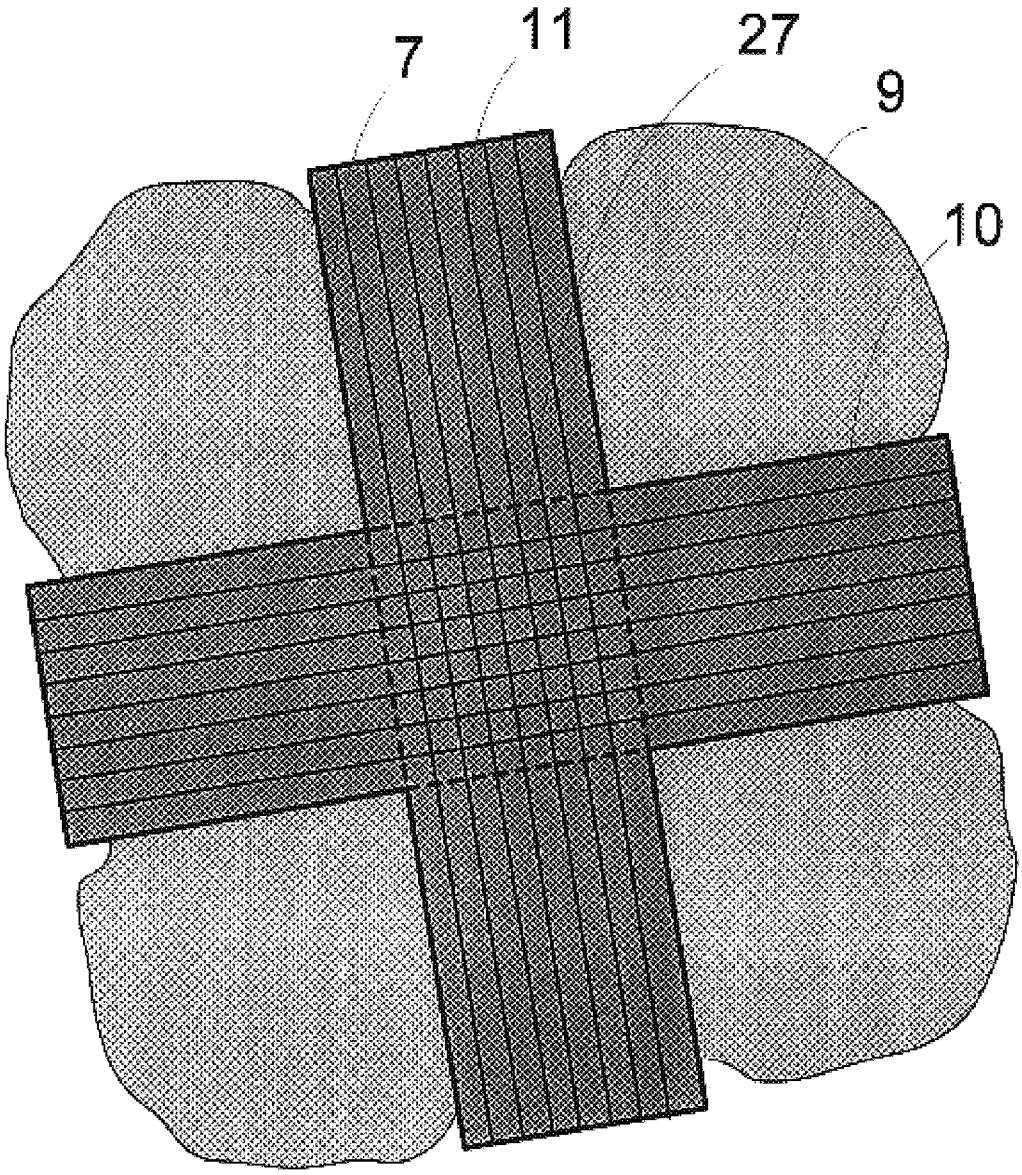
FIG. 13 is a perspective view of an alternative embodiment of a box of the invention which is unfolded, and wherein spring strips are made as one monolithic construction repeating the shape of the box body.

In FIG. 13 is shown an alternative embodiment, wherein the spring strips 11 are made as one monolithic construction repeating the shape of the box body 1.

The box described in alternative embodiments operates same way as described in the preferred embodiment above.

There are various possibilities with regard to the material of which the box body is made, as well as size, shape, content and purpose of the box.

Figure 2:
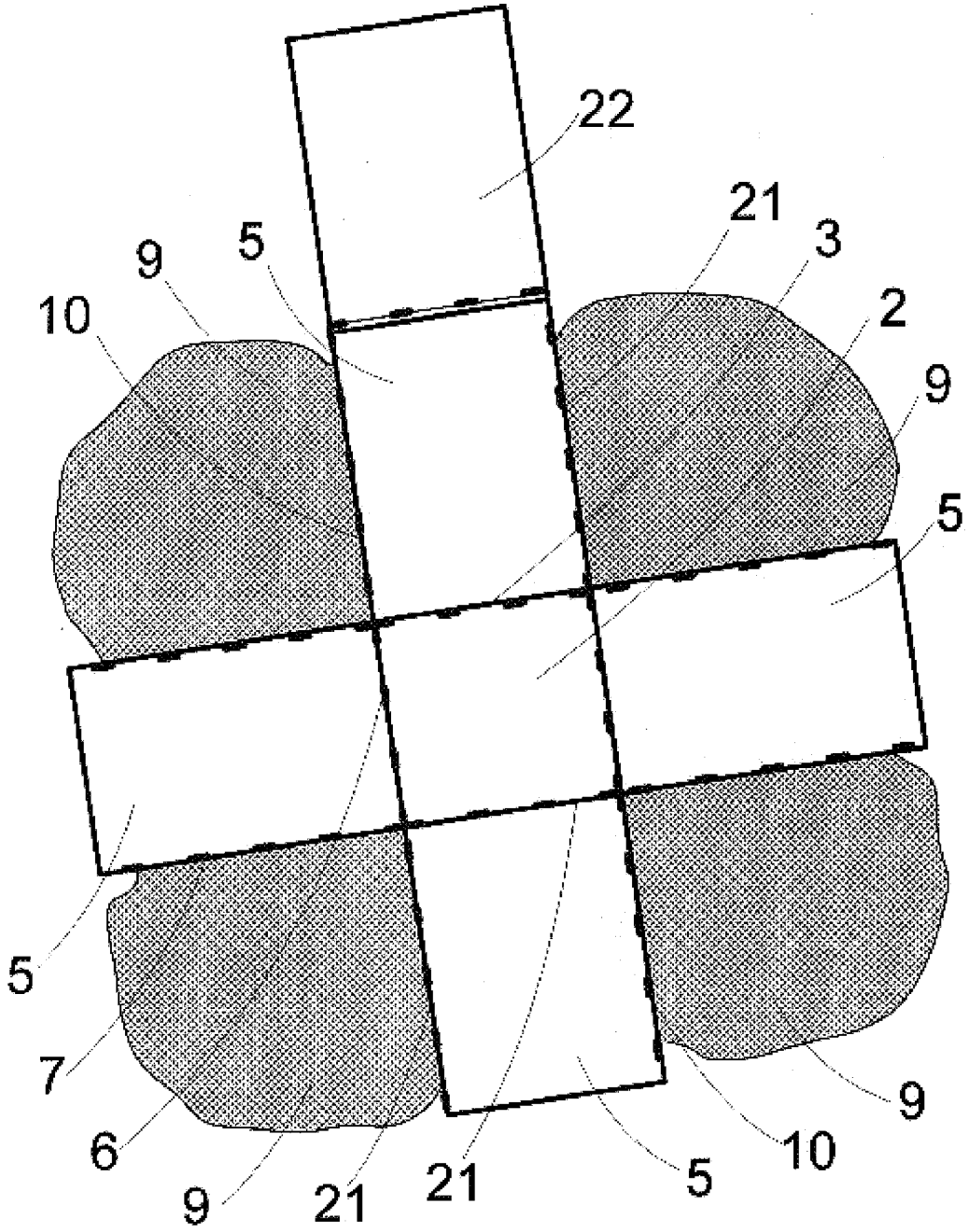
FIG. 2 is a perspective view of an embodiment, shown in unfolded condition.
Figure 14:
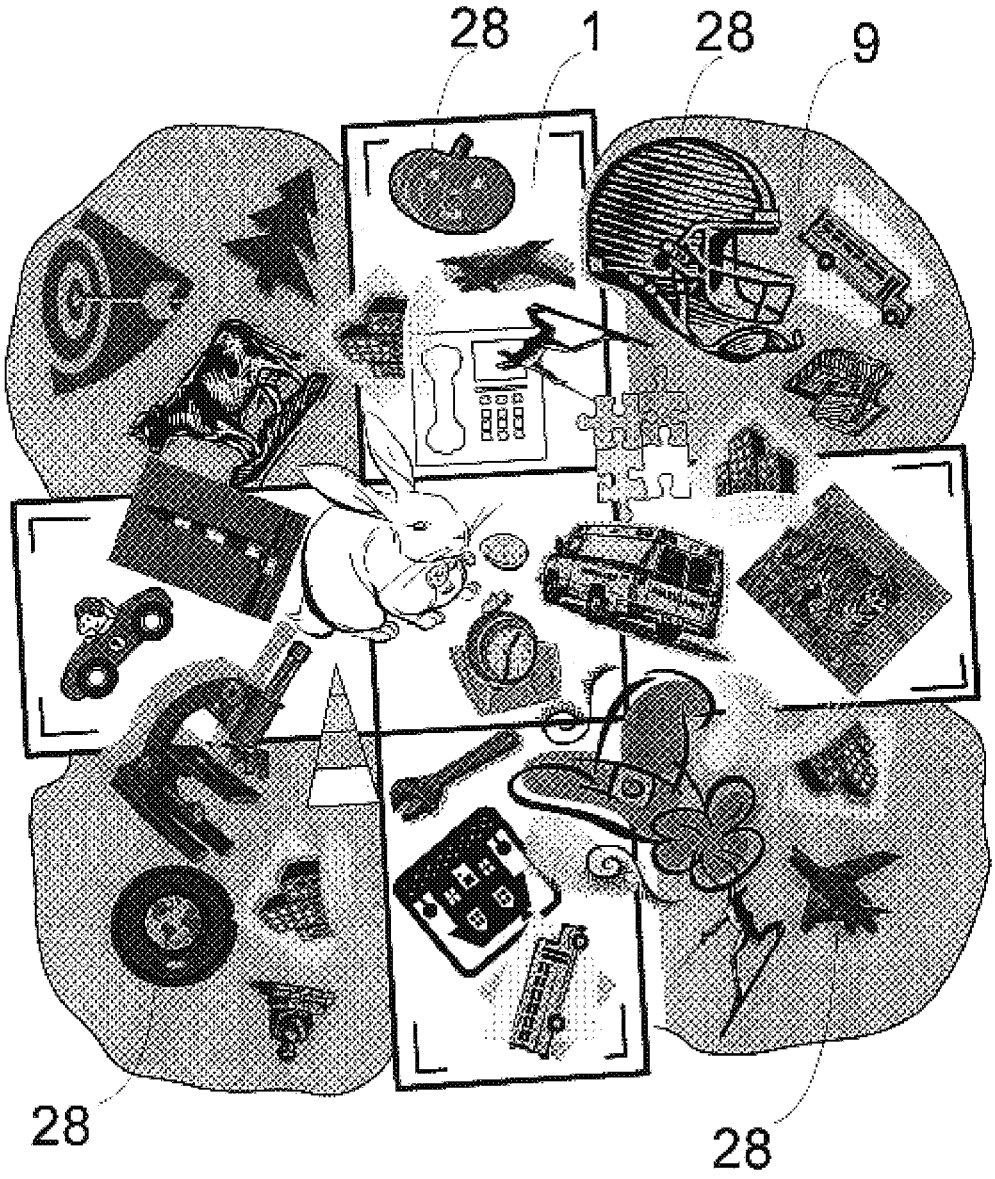

FIGS. 2, 14, and 15 show the box made as a box for storing the children's toys.

Figure 16:
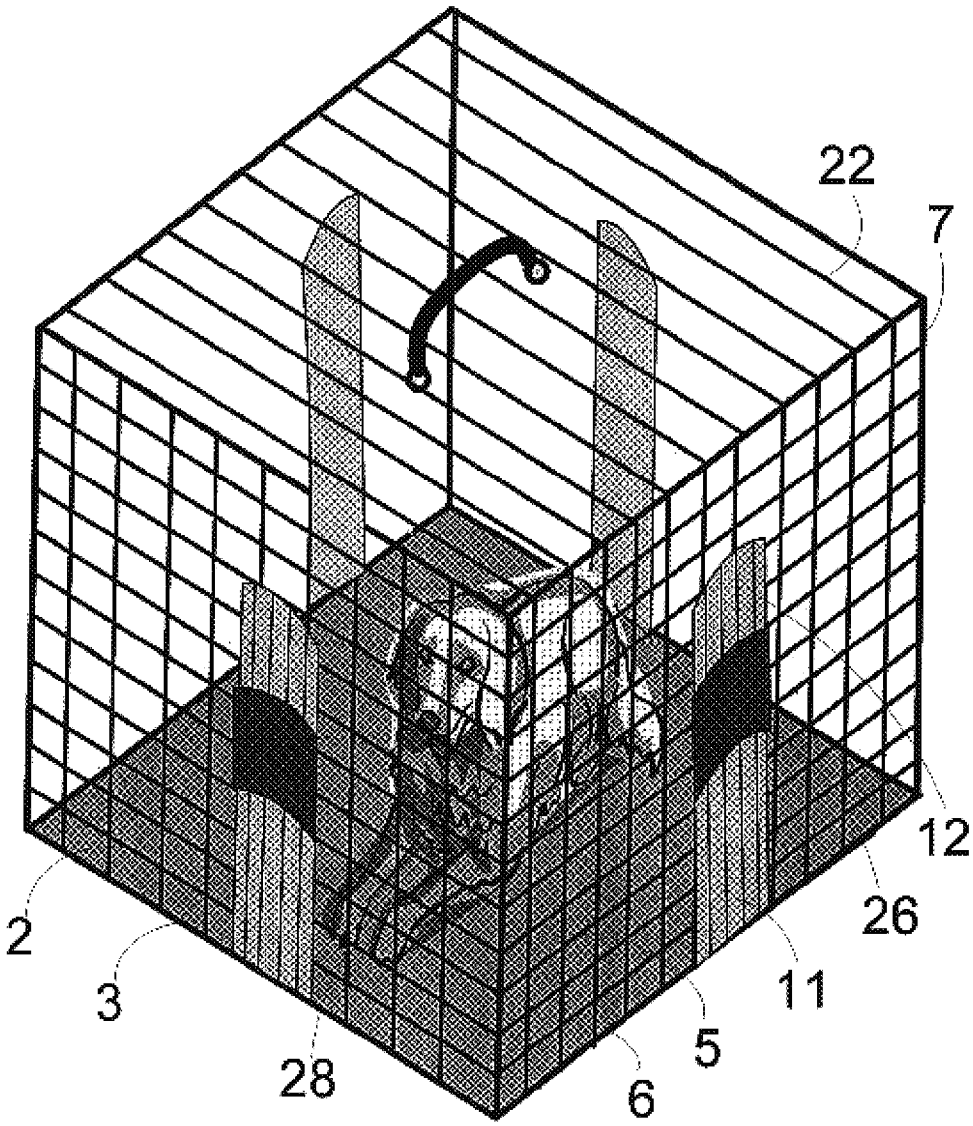

FIG. 16 shows the box made as a cage for transporting pets, wherein side walls 5 are made of metal grids.

Figure 17A:
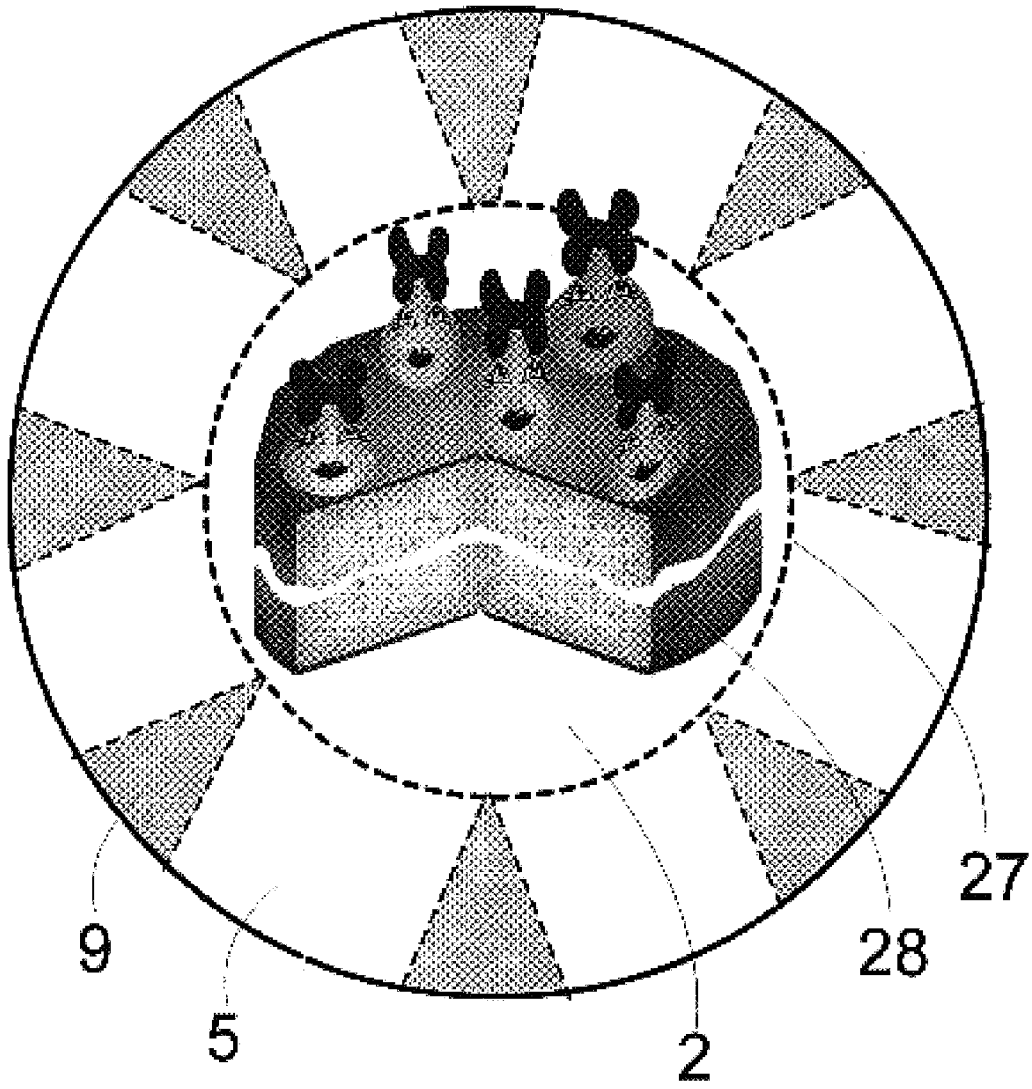
Figure 17B:
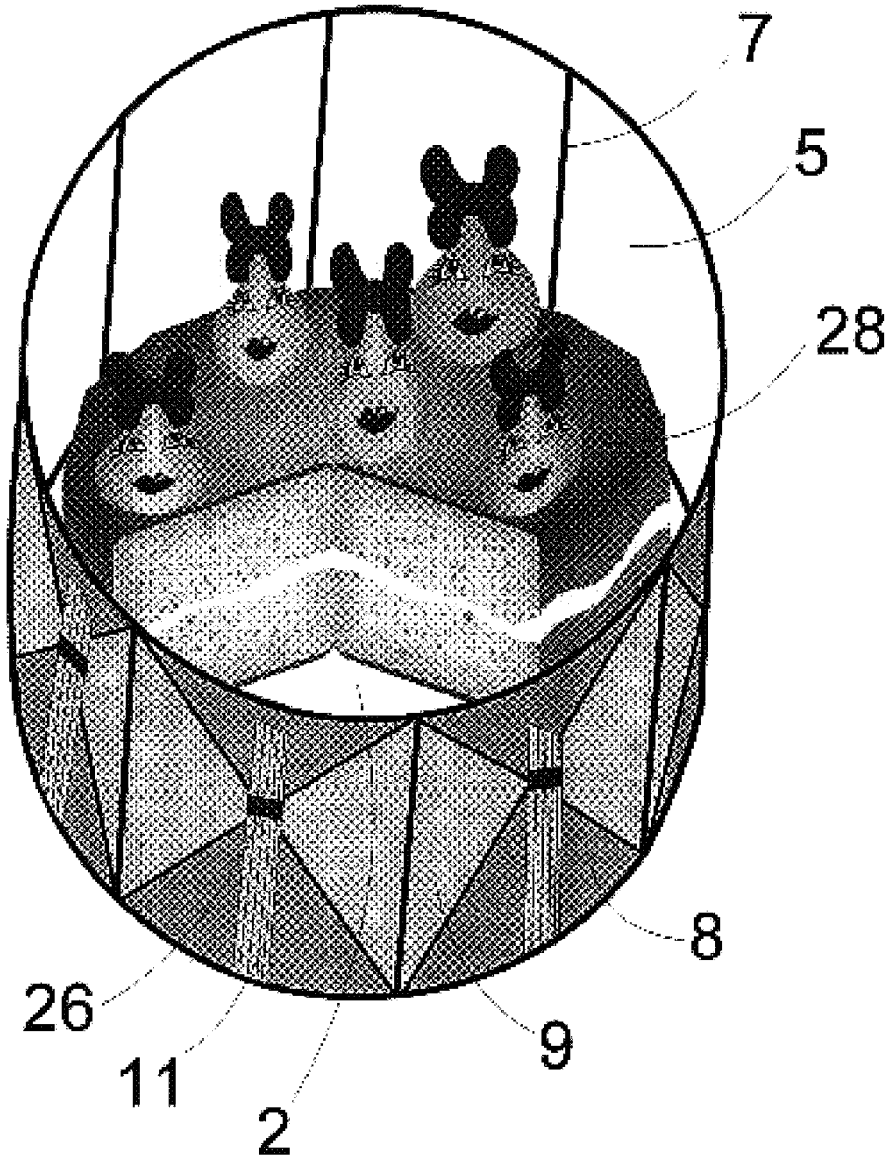

FIGS. 17*a* and 17*b* show the box made as a cake box, which is convertible to a plate.

Conclusion, Ramifications, and Scope

Accordingly, the reader will see that the box of this invention can be utilized for a variety of different storage applications, from personal small items to toys and laundry, and to various home appliances and tools. Being suitable for manufacturing at different sizes, shapes and material, it can be used as a container for food stuffs, or a container for transporting and storing fresh fruits and vegetables, or as a cage for convenient transportation of pets, etc. Furthermore, the box has the additional advantages in that

- it provides for a semi-automatic foldable box, which can be easily and quickly unfolded flat, and available as a sheet or carpet when unfolded;
- it provides for a semi-automatic foldable box, which can be instantly unfolded flat or folded back to its erected position for storing of the contents, allowing easy access to the contents of the box and without the need to remove the contents from the box prior to its folding or unfolding;
- it provides for a semi-automatic foldable box, which can be easily and quickly assembled and set up when in use, and conveniently collapsed and disassembled when not in use;
- it provides for a semi-automatic foldable box, which, when each side wall rises, is box-like-shaped to form the box, and is sheet-like shaped when each side wall is unfolded to be available as a sheet or carpet, thereby enabling effective utilization of space when unfolded, stored or transported;
- it provides for a semi-automatic foldable box, which in its collapsed (disassembled) state will occupy relatively small space;
- it provides for a semi-automatic foldable box, which is reusable;
- it provides for a semi-automatic foldable box, which is durable and can be used in any kinds of environment in which a box would be used;
- it provides for a semi-automatic foldable box, which is very economical and efficient it terms of material requirement;
- it provides for a semi-automatic foldable box, which is easily constructed from readily available materials and manufacturing process and which is therefore both inexpensive and readily adapted for different purposes and uses;
- it provides for a semi-automatic foldable box, any part of which can be easily replaced with the new one, thereby ensuring longevity of the box's life;
- it provides for a semi-automatic foldable box, which can be effectively used for storage of children's toys and will allow the children to instantly turn the toy box into a playing field where all toys stored in the box are available immediately after an easy and quick unfolding of the box; and
- it provides for a semi-automatic foldable box, which, if necessary, is capable of stacking-up to bear heavy load for a relatively long period of time.

The above description and examples should be not construed as limitations on the scope of the invention. Many other variations are possible. Accordingly, the scope of the invention is determined by the claims and their legal equivalents.

What is claimed is:

1. An universal semi-automatic foldable box comprising:

(a) a box body having a bottom panel and at least two side walls connected to respective side edges of said bottom panel such that said side walls can be unfolded and raised;

(b) internal or external sheets connecting side edges of said side walls, respective corners of each sheet positioned between side edges of adjacent side walls forming connecting portions for connecting adjacent side walls respectively, said connecting portions are capable of folding when the respective adjacent side walls are raised; and (c) elongated self-folding spring strips, each connected to said bottom panel and at least one side wall, said spring strips operating to self-fold to thereby raise said side walls and form the box, said self-folding spring strips each having a concave side and a convex side and the property that, when straightened, it holds its straightened shape, and when bent in a predetermined direction, it self-folds.

2. Said box of claim 1, wherein said spring strip is composed of carbon spring steel.

3. Said box of claim 1, wherein said spring strip is composed of a stiff plastic material.

4. Said box of claim 1, wherein said side walls are connected to said bottom panel detachably, and said sheets are connected to said side edges of said side walls detachably, and said spring strips are connected to said bottom panel and said at least one side wall detachably.

5. Said box of claim 1, wherein said box body is a one-piece die-cut board.

6. Said box of claim 1, wherein said spring strips are secured to said bottom panel and said side walls by means of retaining and fastening elements.

7. Said box of claim 1, further comprising connecting means provided in said side edges of said side walls to facilitate interconnection of said adjacent side walls and form the box.

8. Said box of claim 7, wherein said connecting means are magnets.

9. Said box of claim 1, further comprising means attached to a portion of said spring strip to prevent an initiation of self-folding of said strip at said portion.

10. Said box of claim 1, further comprising a locking system disposed at an outer side of said side walls to hold said adjacent side walls together when said box is in folded condition.

11. Said box of claim 10, wherein said locking system are tab and slot engagements.

12. Said box of claim 1, further comprising a lid supported to at least one said side walls such that said lid can open and close with respect to said box body.

13. Said box of claim 1, further comprising wheels, caterpillar track or other means attached to said bottom panel such that said box can move.

14. Said box of claim 1, further comprising attachments, said attachments comprising any combination of:

(a) connecting means provided in said side edges of said side walls to facilitate interconnection of said adjacent side walls and form the box;

(b) retaining and fastening elements disposed at an outer side of said side walls and said bottom panel, said retaining and fastening elements designing to secure said spring strips to said bottom panel and said side walls;

(c) means attached to a portion of said spring strip to prevent an initiation of self-folding of said strip at said portion;

(d) a locking system disposed at an out side of said side walls to hold said adjacent side walls together when said box is in folded condition;

(e) a lid supported to at least one said side walls such that said lid can open and close with respect to said box body;

(f) wheels, caterpillar track or other means attached to said bottom panel such that said box can move; and (g) any other attachments facilitating use and utilization of said box.

* * * * *